US008606165B2

(12) United States Patent
Kovacs et al.

(10) Patent No.: US 8,606,165 B2
(45) Date of Patent: Dec. 10, 2013

(54) EXTENDED ZONE LOW TEMPERATURE NON-CONTACT HEATING FOR DISTORTION FREE FUSING OF IMAGES ON NON-POROUS MATERIAL

(75) Inventors: Gregory J. Kovacs, Webster, NY (US); Ashish Pattekar, Cupertino, CA (US); David Biegelsen, Portola Valley, CA (US); Lars E. Swartz, Sunnyvale, CA (US); Guerino G. Sacripante, Oakville (CA); T. Brian McAneney, Burlington (CA); Edward G. Zwartz, Mississauga (CA)

(73) Assignees: Xerox Corporation, Norwalk; Palo Alto Research Center Incorporated, Palo Alto, CA (US)

( * ) Notice: Subject to any disclaimer, the term of this patent is extended or adjusted under 35 U.S.C. 154(b) by 444 days.

(21) Appl. No.: 12/112,848

(22) Filed: Apr. 30, 2008

(65) Prior Publication Data

US 2009/0274499 A1 Nov. 5, 2009

(51) Int. Cl.
*G03G 15/20* (2006.01)

(52) U.S. Cl.
USPC ..... 399/335; 399/320; 399/336; 399/341

(58) Field of Classification Search
USPC ..... 399/335, 336, 337, 338, 341
See application file for complete search history.

(56) References Cited

U.S. PATENT DOCUMENTS

| | | | | |
|---|---|---|---|---|
| 4,639,405 | A * | 1/1987 | Franke | 430/124.13 |
| 5,140,377 | A * | 8/1992 | Lewis et al. | 399/335 |
| 5,370,963 | A * | 12/1994 | Patel et al. | 430/137.14 |
| 5,805,969 | A * | 9/1998 | Elsermans et al. | 399/341 |
| 5,970,301 | A * | 10/1999 | De Cock | 430/124.3 |
| 5,983,063 | A * | 11/1999 | De Niel et al. | 399/335 |
| 6,067,437 | A * | 5/2000 | Schonfeld | 399/320 |
| 6,730,450 | B1 | 5/2004 | Moffat et al. | |
| 6,756,169 | B2 | 6/2004 | Lin et al. | |
| 6,827,435 | B2 | 12/2004 | Domoto et al. | |
| 6,830,860 | B2 | 12/2004 | Sacripante et al. | |
| 6,909,871 | B2 * | 6/2005 | Behnke et al. | 399/336 |
| 7,031,626 | B1 | 4/2006 | Stelter et al. | |
| 7,058,348 | B2 * | 6/2006 | Aslam et al. | 399/341 |
| 7,092,664 | B2 * | 8/2006 | Bartscher et al. | 399/320 |
| 7,097,954 | B2 | 8/2006 | Hawkins et al. | |
| 7,250,238 | B2 | 7/2007 | Fromm et al. | |
| 7,312,011 | B2 | 12/2007 | Patel et al. | |
| 7,326,508 | B2 | 2/2008 | Maeyama et al. | |
| 7,335,453 | B2 | 2/2008 | Sacripante et al. | |
| 7,532,015 | B2 | 5/2009 | Tanbakuchi et al. | |
| 7,801,475 | B2 * | 9/2010 | Biegelsen et al. | 399/335 |
| 7,848,668 | B2 | 12/2010 | Condello et al. | |
| 7,890,043 | B2 * | 2/2011 | Biegelsen et al. | 399/335 |
| 2002/0154928 | A1 * | 10/2002 | Bartscher et al. | 399/336 |
| 2005/0287464 | A1 | 12/2005 | Cheng et al. | |
| 2009/0154968 | A1 * | 6/2009 | Biegelsen et al. | 399/335 |

* cited by examiner

*Primary Examiner* — David Gray
*Assistant Examiner* — Francis Gray
(74) *Attorney, Agent, or Firm* — Fay Sharpe LLP

(57) ABSTRACT

A system for heated gas fusing of toner on non-porous substrates is provided. The system uses (1) an extended fusing zone held at lower temperatures than needed for a roll nip or radiant fuser, and (2) a very low melt toner which can be fused at greatly reduced temperatures compared to conventional toners. In one form, the system is realized through (a) the use of heated gas as the low temperature extended zone fusing technology, and (b) the use of ultra-low melt (ULM) toner—which requires significantly reduced temperature compared to conventional toner. On non-porous packaging substrates the use of heated gas can limit the substrate temperature to 100° C.

24 Claims, 5 Drawing Sheets

EXTENDED ZONE LOW TEMPERATURE NON-CONTACT HEATING FOR DISTORTION FREE FUSING OF IMAGES ON NON-POROUS MATERIAL

BACKGROUND

In the process of xerography, a light image of an original to be copied or printed is typically recorded in the form of a latent electrostatic image upon a photosensitive member, and the electroscopic marking particles, commonly referred to as toner, are developed onto the photosensitive member. The visual toner image is then transferred from the photosensitive member to a sheet of plain paper with subsequent permanent bonding of the image thereto. This bonding of the toner particles onto the paper generally comprises two steps: a first step wherein the toner particles on the paper are partially melted, or otherwise made fluid; and a second step, in which the fluid toner particles are bonded to the paper. In general parlance, these two steps are conceptually combined (since, in many common techniques, the two steps occur substantially simultaneously), and the two steps are together known in the art simply as "fusing."

In order to fuse the image formed by the toner onto the paper, electrophotographic printers incorporate a device commonly called a fuser. While the fuser may take many forms, heat or combination heat-pressure fusers are currently most common. As one example, one combination heat-pressure fuser includes a heat fusing roll in physical contact with a pressure roll. These rolls cooperate to form a fusing nip through which the copy sheet (the sheet on which the document is finally formed) passes.

Although hot-roll fusing is currently the most common method of fusing in commercially-available electrophotographic printing machines today, numerous other fusing techniques are well known in the art. Fusing by heat alone, by exposing the copy sheet to a heat source, was often used in early plain-paper copying machines. Another popular technique is flash fusing, in which a copy sheet is exposed to a quick and intense flash of radiation which heats only the top surface of the sheet and more specifically mainly the relatively dark areas of toner on the sheet. Finally, another common technique is cold pressure roll fusing, in which no external source of heat is used, and the fusing is carried out by extremely high physical pressure on the sheet. This technique has the advantages of consuming little power, and not requiring any warm-up time, but has the disadvantages of creating images of undesirable gloss and providing a poor fix on solid areas of an image so the toner may come off easily.

Another important technique for fusing is chemical vapor fusing. In this technique, toner on the surface of a copy sheet is made fluid by exposure to a gaseous solvent. Chemical vapor fusing is most often used in situations where high temperatures are to be avoided and thermal fusing would damage the copy sheet. However, many vapor solvents, such as halogenated hydrocarbons, will emit dangerous fumes or become explosive in a high-temperature environment.

No matter which type of fusing is used in an electrophotographic apparatus, fusing is one of the most constraining parameters in the design of any system. Heat-generating fusers consume from 55 to 70 percent of a machine's power during warmup, and require most of the warmup time. Cold roll fusers and flash fusers require large volumes of space in a machine. In hot roll or cold roll fusing, the dwell time of a copy sheet through the fuser is one of the most important limits to the speed of the machine. The fuser is often responsible for most of the environmental problems of a machine, such as noise, heat, and odor. Finally, the fusing step is one of the most crucial in regards to final copy quality. Improper fusing can cause smearing, lack of uniformity of an image, and/or unattractive mottled appearance to an image. For these reasons, designers of copying machines and printing systems require a great flexibility in selecting which type of fuser they wish to use.

When printing on thin, plastic flexible packaging, more difficulties arise in addition to those noted above for printing on paper. For example, xerographic digital printing on thin, flexible film such as plastic may result in unacceptable distortion of the substrates during the roll fusing or radiant fusing process. This is typically due to the excessive substrate temperatures (130-220° C.) reached. In particular, conventional toner materials must typically be heated to high substrate temperatures (130-220° C.) to enable good fusing.

For example, a very commonly used packaging substrate is DuPont Mylar. Digital xerographic printing on Mylar for packaging applications requires a toner fusing step. For either roll nip or radiant fusing of conventional toners, substrate temperatures of 130-220° C. or even higher are typically required to achieve good fusing fix. However, as can be seen from FIG. 1, Mylar substrates undergo significant shrinkage/distortion when subjected to these temperatures in both the machine direction (MD) and the transverse direction (TD). The distortion of Mylar based packaging substrates caused by these fusing temperatures results in an unacceptable packaging film. To reduce this distortion to an acceptable level, fusing temperatures not too much higher than 100° C. are desired.

Therefore, to enable xerographic digital printing without distortion of thin, flexible packaging substrates, there is a need (a) for fusing methods which enable fusing at reduced temperatures below the distortion temperatures of packaging substrates, and (b) for toner materials which fuse at reduced temperatures to enable xerography as a viable technology for digital flexible packaging printing.

BRIEF DESCRIPTION

In one aspect of the presently described embodiments, the system comprises a fusing zone defined in a print path for the substrate, a heating tank operative to receive fluid and heat the fluid to produce heated gas, and an application device positioned in the fusing zone operative to apply the heated gas to the toner on the substrate.

In another aspect of the presently described embodiments, the toner is an ultra-low melt toner and/or has a softening temperature less than approximately 140° C.

In another aspect of the presently described embodiments the substrate is a plastic material.

In another aspect of the presently described embodiments, the fusing zone is sized to facilitate toner fusion at approximately 100° C.

In another aspect of the presently described embodiments, the heated gas is one of steam or hot air.

In another aspect of the presently described embodiments, the toner is emulsion aggregation toner.

In another aspect of the presently described embodiments, the emulsion aggregation toner has a particle size of 3-4 microns with a pile height of approximately 2-3 microns.

In another aspect of the presently described embodiments, the substrate is a thin plastic, foil or paper material or a laminate thereof as thin as approximately 13 microns or less, which can be rewound with minimal distortion due to the printed toner and is suitable for subsequent packaging operations.

In another aspect of the presently described embodiments, the application device comprises a plurality of heated gas knives wherein a heated gas knife is defined as the flow field formed when heated gas is ejected through a narrow slit (e.g., less than 2 cm) at velocities higher than approximately 5 cm/s.

In another aspect of the presently described embodiments, the system further comprises a second fusing zone on an opposite side of the substrate and a corresponding second jetting device.

In another aspect of the presently described embodiments, the system further comprises a glossing unit.

In another aspect of the presently described embodiments, the method comprises applying a toner to the nonporous substrate, conveying the substrate having toner thereon through a fusing zone, applying heated gas to the toner and the substrate in the fusing zone to fuse the toner to the substrate, and, drying the substrate.

In another aspect of the presently described embodiments, the toner is an ultra low melt toner and/or has a softening temperature less than approximately 140° C.

In another aspect of the presently described embodiments, the toner is fused at approximately 100° C.

In another aspect of the presently described embodiments, the substrate is plastic.

In another aspect of the presently described embodiments, the heated gas is applied using a plurality of heated knives.

In another aspect of the presently described embodiments, the method further comprises applying toner to a second side of the nonporous substrate.

In another aspect of the presently described embodiments, the method further comprises applying heated gas to the second side of the nonporous substrate in the fusing zone to fuse the toner on the second side.

In another aspect of the presently described embodiments, the method further comprises glossing the substrate having toner fused thereon.

In another aspect of the presently described embodiments, the heated gas is one of steam or hot air.

In another aspect of the presently described embodiments, the toner is emulsion aggregation toner.

In another aspect of the presently described embodiments, the emulsion aggregation toner has a particle size of 3-4 microns with a pile height of approximately 2-3 microns.

In another aspect of the presently described embodiments, the substrate is a thin plastic, foil or paper material or a laminate thereof as thin as approximately 13 microns or less, which can be rewound with minimal distortion due to the printed toner and is suitable for subsequent packaging operations.

DETAILED DESCRIPTION

Figure 1:
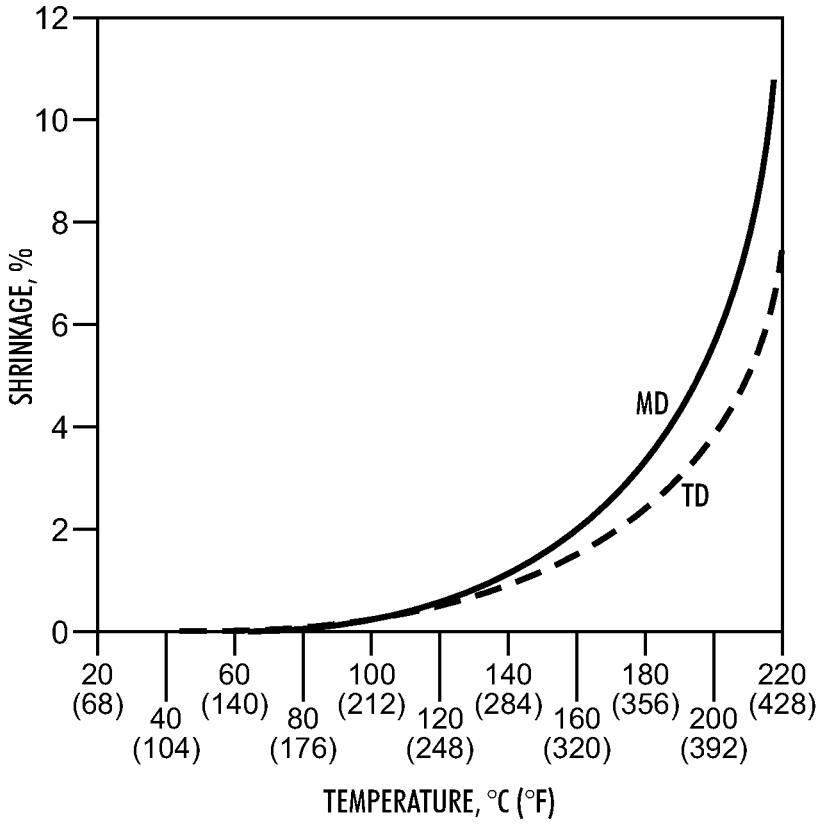
FIG. 1 is a chart illustrating shrinkage versus temperature for a particular material.

The presently described embodiments enable fusing of xerographic images without distortion of flexible packaging substrates. To accomplish this, the techniques of the presently described embodiments use (1) an extended fusing zone held at lower temperatures than needed for a roll nip or radiant fuser, and (2) a very low melt toner which can be fused at greatly reduced temperatures compared to conventional toners. The presently described embodiments are realized, at least in one form, through (a) the use of heated gas, e.g. steam or hot air, as a low temperature extended zone fusing technology, and (b) the use of ultra-low melt (ULM) toner (including emulsion aggregation (EA) toners that produce a very low pile height)—which requires significantly reduced fusing temperature compared to conventional toner. On non-porous packaging substrates (such as plastic), the use of steam can limit the substrate temperature to 100° C., and well controlled use of hot air over an extended heating zone can do the same. Other types of heated gas may also be used in the system. A system according to the presently described embodiments, thus, provides a thermal budget which maintains substrate distortion at acceptable levels, or below predetermined threshold values. It should be understood that, while 100° C. provides an example threshold for some materials, achieving favorable results at or below any temperature at which significant substrate distortion occurs is contemplated by the presently described embodiments. FIG. 1 shows the shrinkage of Mylar as a function of temperature in both the machine direction (MD) and in the transverse direction (TD). From FIG. 1, it is apparent that for Mylar the threshold value for significant shrinkage is approximately 100° C.

Heated gas, e.g. steam or hot air, fusing is a particularly advantageous fusing technique which achieves the goals of this invention when used in conjunction with Xerox ultra low melt (ULM) toners. Generally, the contemplated ULM toners have a softening point less than 140° C. Examples of such toner materials are described in U.S. Pat. No. 7,335,453, U.S. Pat. No. 7,312,011 and U.S. Pat. No. 6,830,860, all of which are incorporated herein in their entirety by this reference. Emulsion aggregation (EA) toners may also be used. Examples of such toner materials are described in U.S. Pat. No. 5,370,963 which is incorporated herein in its entirety by this reference. In at least one form, the EA toners used have a very low pile height. The low pile height (e.g. 2-3 microns) is realized because at least some EA toners have a particle size of approximately 3-4 microns. This achieves an additional advantage—the take-up roll in the printing system is able to maintain a more conventional (or circular) shape for effective performance, i.e. a distortion free rewound roll results. High pile toners fused on plastic may cause the take-up roll in the printer to deform in a manner that is undesirable, e.g. for subsequent packaging operations. Other advantages of the use of EA toner include low temperature fusing and lessened toner mass for a given image (translating to reduced cost).

It should be understood that the presently described embodiments may be implemented in a variety of different environments including xerographic printing environments. For example, the heated gas, e.g. steam or hot air, fusing system may be used in a printing system to print on a continuous web or on single sheets that are fed through the system. Likewise, the heated gas, e.g. steam or hot air, fusing system may be used in a copier or copier/printer combination device, if desired.

Figure 2:
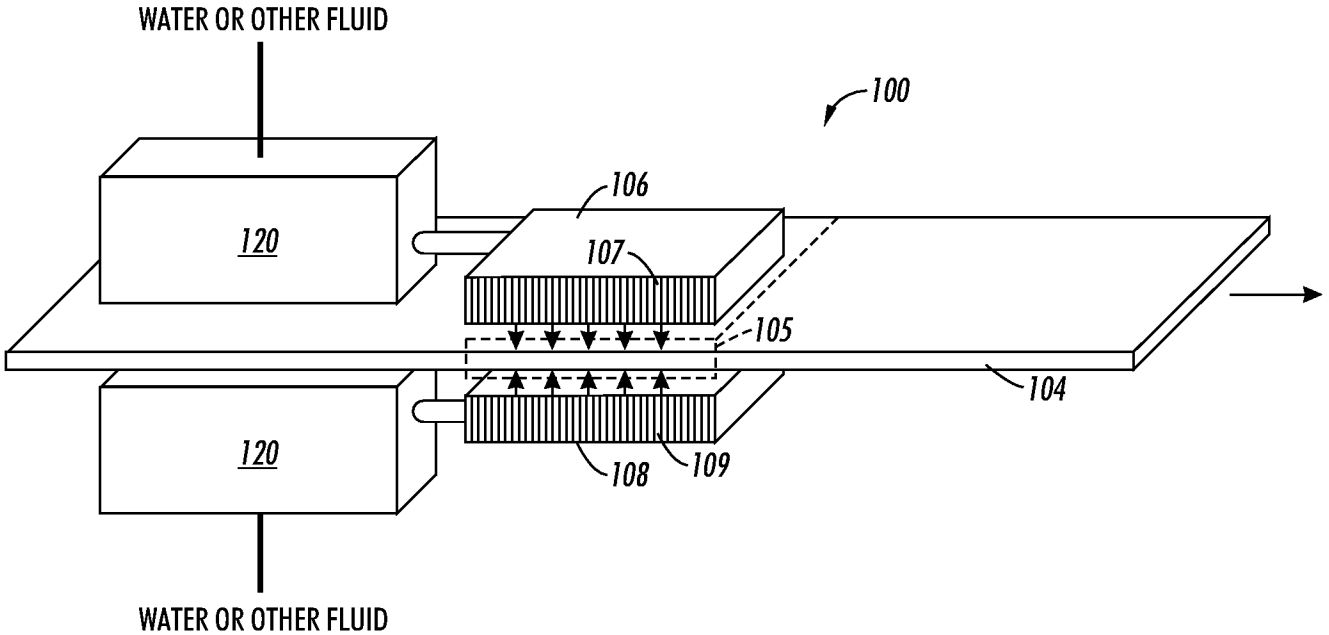
FIG. 2 is a perspective view of a fusing system according to the presently described embodiments.

With reference now to FIG. 2, an example system 100 is illustrated. As shown, the fusing system 100 is used for fusing toner on a substrate 104, which may be a web-like material or single sheet. It should be understood that the substrate has toner applied thereto using any of a number of conventional techniques. The substrate 104 is conveyed (by any suitable mechanisms or means) into an extended fusing zone (shown by arrows and the dashed lines) 105 and is maintained in the fusing zone for sufficient amount of time in order to fuse the toner to the substrate 104. The system 100 also includes an application device 106. The application device 106, in one form, comprises a plurality of steam or hot air knives 107. A heated gas knife such as a steam or hot air knife, in at least one form, is defined as a field flow of steam or hot air when steam or hot air is ejected through a narrow slit (e.g. <2 cm) at velocities higher than approximately 5 cm/s. The plurality of steam or hot air knives 107 is configured to define the extended fusing zone 105. The application device 106 is connected with a heating tank 120. The tank 120 is operative to receive fluid such as water or air and heat the fluid, e.g. water or air, to produce a heated gas, e.g. steam or hot air, which is then applied to the substrate 104 by application device 106.

Also shown in FIG. 2 is a second application device 108, comprised of steam or hot air knives 109, and a second water or air tank 120. It should be appreciated that the provision of the second application device and second water or air tank is optional but will allow for the fusing of toner on both sides of the substrate 104.

As noted above, the system 100 is merely exemplary in nature. Any system, including xerographic and xerographic digital printing systems, contemplated by the presently described embodiments may take a variety of different forms as a function of the environment in which it is implemented. For example, for high speed printing on web-like material such as that used in the packaging industry, a different form of the heated gas or steam/hot air fusing system will be realized—as will be described hereafter in connection with FIG. 4.

Figure 4:
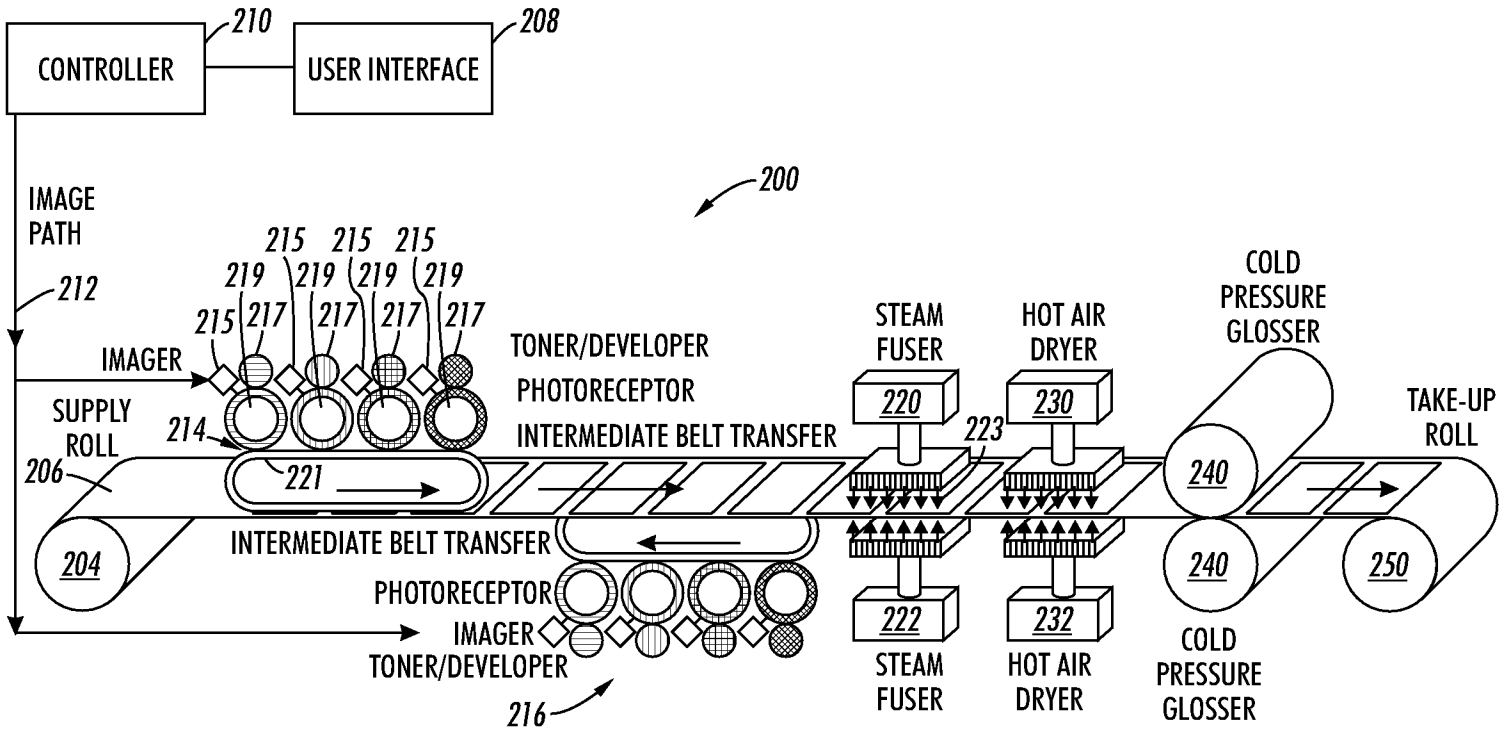
FIG. 4 is an illustration of printing system according to the presently described embodiments; and, FIG. 5 is a flow chart illustrating a method according to the presently described embodiments.

With reference now to FIG. 4, a printing system 200 is illustrated. Again, it should be understood that the illustrated system is merely representative. It should also be understood that certain components included in this representation, such as the interface, controller, belts, rolls, glossing unit, developers, photoreceptors, imagers and dryers, are well known in the art and, for the sake of brevity, will not be described in detail herein.

The system 200 includes a spool or supply roll 204 that feeds a nonporous substrate 206 through the system 200. It should be appreciated that the nonporous substrate 206 is, in at least one form, flexible and takes the form of, for example, a plastic. A specific type of material, in this regard, is Mylar. Other similar plastic or non-porous materials may also be used. These may include other forms of thin plastic, foil or paper material. Laminates formed of various combinations of these materials noted above (or others) may also comprise the substrate. In general, the non-porous material contemplated by the presently described embodiments, is material that distorts (e.g., distorts to an unacceptable level) with heat. Also, the material, in some forms (including some laminate forms), may be as thin as approximately 13 microns or less.

The system 200 includes a user interface 208 that allows a user to communicate with a controller 210. The controller 210 controls an image path 212 upon which an image is conveyed to a developer and transfer unit 214. Unit 214—which typically includes imagers 215, toner/developer rolls 217, photoreceptor rolls 219, and an intermediate transfer belt 221—applies the image to the substrate 206, which is then conveyed into a fusing zone 223. The fusing zone 223 may take a variety of forms; however, in at least one form, it will be defined by a steam fuser 220. The steam fuser 220 may likewise take a variety of forms. In at least one form, the steam fuser 220 is comprised of an application device (such as the application device 106 of FIG. 2) having a plurality of steam knives (such as the steam knives noted above). When the substrate having the toner applied thereto is in the fusing zone 223, the steam fuser 220 acts on the substrate 206 to apply steam in such manner so as to fuse the toner to the substrate.

Optionally, the substrate is dried using a dryer 230. It should be appreciated that a mechanism to facilitate drying may not be necessary. Drying could be realized through air drying—such air being elevated in temperature in many industrial environments.

In some circumstances, the substrate/toner is sent through a glossing unit such as a cold pressure glosser 240. In this regard, the steam fusing of plastic substrates according to the presently described embodiments may use regular toners on packaging materials. However, high gloss is typically not achieved using regular toners and the contemplated steam fusing system. So, such a system may use the downstream glossing unit 240. In one form, cold hard rollers are used in the glossing unit so as to not distort the substrate.

Also shown is a take-up roll 250. As noted above, in at least some forms where EA toner is used to achieve low image pile height, the shape of the substrate on the take-up roll 250 will be maintained as close as possible to a desired shape such as a circle. Again, this is possible because the particle size of the EA toner used is approximately 3-4 microns, in at least one form, and fuses to the substrate to achieve a pile height (for the image on the substrate) of 2-3 microns. This is generally acceptable pile height to avoid a distorted rewound roll for a substrate that is as thin as, for example, approximately 13 microns.

Also illustrated in FIG. 4 are a second developer 216, a second steam fuser 222, and a second dryer 232. It will be understood that these components take on a similar form to their counterparts 214, 220 and 230. These optional devices allow for printing to be accomplished on both sides of the substrate. It should be noted that, in other embodiments, the steam fusers 220 and 222 could be simple hot air fusers, and the hot air dryers 230 and 232 may not be used at all.

It should be appreciated that the steam or hot air fuser 220 (or 222) may include heating tanks, such as those shown in FIG. 2, to heat water and/or air. Alternatively, the heating tanks may be conveniently positioned, for example, within the system, in the print path, or outside of the print module, to communicate steam or hot air to an application device, such as application device 106 or 108 (of FIG. 2) to achieve the objectives of the presently described embodiments. It should be understood that if other forms of heated gas are used (other than steam or hot air), the fluid that is heated will take an appropriate form.

The embodiments of FIGS. 2 and 4 merely represent examples of implementations. Other implementations are contemplated. For example, high volume production for continuously fed single sheets may result in a fusing system taking a different form. In addition, not all implementations of the steam or hot air fusing system according to the presently described embodiments will allow for fusing on both sides of a substrate using a second application device.

Also, while steam fusing used with non-porous packaging substrates is, in at least one form, self-limiting to fusing temperatures not higher than 100° C., higher temperatures can also be used through superheated steam. If higher temperatures are used, however, a thermal budget which keeps substrate distortion below threshold values should be considered.

In operation, the presently described embodiments will generally vary as a function of a number of factors—such as the temperature of the heated gas, e.g. temperature of the steam or hot air, the size and configuration of the fusing zone, the number of r heated gas knives that may be used in the application device, and/or the time period in which the substrate/toner combination is exposed to the application device in the fusing zone. For example, a lower temperature may necessitate a longer exposure time. Consequently, a longer exposure time may necessitate a longer fusing zone—which may, in turn, dictate that a higher number of knives may be necessary.

Figure 5:
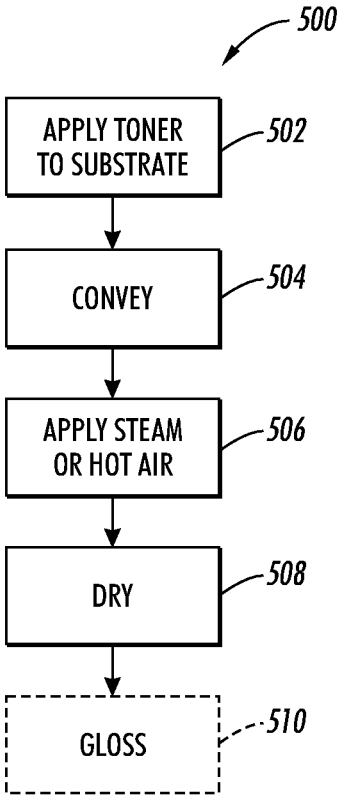

The various implementations described above and/or contemplated herein may be operated according to a number of different methods to achieve the objectives of the presently described embodiments. For example, FIG. 5 illustrates an example method 500 according to the presently described embodiments.

In this method 500, toner is applied to a substrate (at 502). As noted above, in at least one form, the toner is an ultra-low melt (ULM) toner and the substrate is a web-like swath of plastic, such as Mylar Next, the substrate having the toner applied thereto is conveyed into a fusing zone (at 504). The fusing zone may be configured in a variety of different manners; however, in at least one form, the fusing zone is an extended region defined by an application device for applying heated gas such as steam or hot air, e.g. a plurality of steam or hot air knives. Once in the fusing zone, heated gas, such as steam or hot air is applied to the toner on the substrate by, for example, the application device (at 506). The amount of time that the substrate is exposed to the steam or hot air, for example, will vary as a function of a number of factors including, but not limited to, the size of the fusing zone, size of the substrate and desired temperature. Next, the toner is dried (at 508). It is to be appreciated that the toner may be dried by natural progression through the printing device or may be dried using any form of conventional drying unit using radiant energy or forced air. Optionally, as described above, the toner applied to the substrate may be sent to glossing unit (at 510) to achieve a higher gloss on the print material.

Figure 3A:
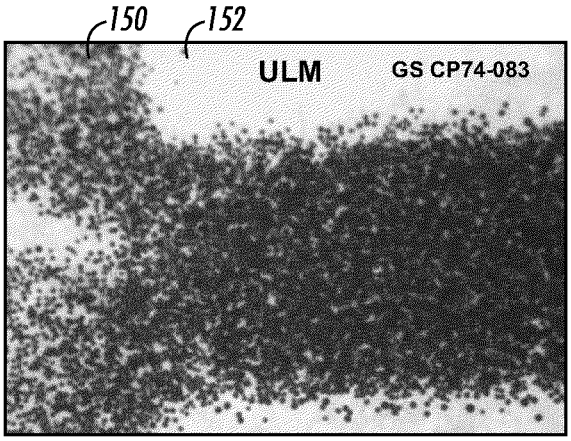
FIGS. 3(*a*) and 3(*b*) illustrate an implementation of the presently described embodiments.
Figure 3B:
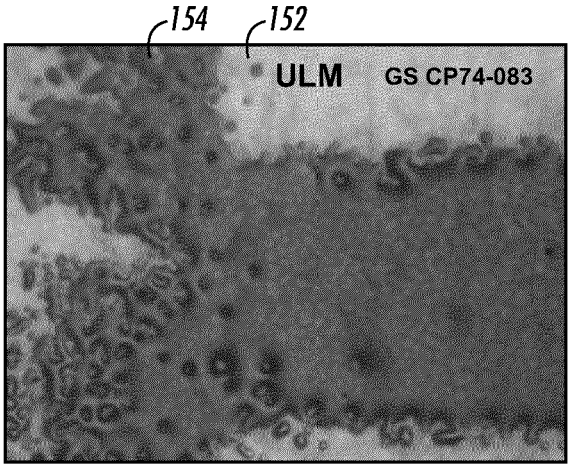

With reference now to FIGS. 3(*a*) and (*b*), the results of an implementation of the presently described embodiments is illustrated. In FIG. 3(*a*), toner 150 is applied to a substrate 152. In FIG. 3(*b*), the result of the application of steam through application device 106 or steam fuser 220 is illustrated. In this regard, substrate 152 has fused toner 154 present thereon. As can be seen, the toner is sufficiently fused to allow for a high quality print using the presently described embodiments.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A fusing system useful for fusing toner on nonporous substrates, the system comprising:

a fusing zone defined in a print path for the nonporous substrate;

a heating tank operative to receive fluid and heat the fluid to produce steam; and, an application device positioned in the fusing zone operative to apply the steam at approximately 100° C. to fuse the toner on the substrate.

2. The system as set forth in claim 1 wherein the toner is an ultra-low melt toner.

3. The system as set forth in claim 1 wherein the toner has a softening temperature less than approximately 140° C.

4. The system as set forth in claim 1 wherein the nonporous substrate is a plastic material which unacceptably distorts with heat at a temperature above 130° C.

5. The system as set forth in claim 1 wherein the toner is an emulsion aggregation toner.

6. The system as set forth in claim 5 wherein the emulsion aggregation toner has a particle size of 3-4 microns with a pile height of approximately 2-3 microns.

7. The system as set forth in claim 1 wherein the substrate is a thin plastic, foil or paper material or a laminate thereof as thin as approximately 13 microns or less, which can be rewound with minimal distortion due to the printed toner and is suitable for subsequent packaging operations.

8. The system as set forth in claim 1 wherein the application device comprises a plurality of steam knives disposed in the fusing zone wherein a steam knife is defined as the flow field formed when steam is ejected through a narrow slit (e.g., less than 2 cm) at velocities higher than approximately 5 cm/s.

9. The system as set forth in claim 1 further comprising a second fusing zone on an opposite side of the substrate and a corresponding second application device.

10. The system as set forth in claim 1 further comprising a glossing unit.

11. A toner fixing method for printing on a nonporous substrate, the method comprising:

applying a toner to the nonporous substrate;

conveying the nonporous substrate having toner thereon through a fusing zone;

applying steam at approximately 100° C. to the toner and the nonporous substrate in the fusing zone to fuse the toner to the nonporous substrate; and, drying the nonporous substrate.

12. The method as set forth in claim 11 wherein the toner is an ultra-low melt toner.

13. The method as set forth in claim 11 wherein the toner has a softening temperature less than approximately 140° C.

14. The method as set forth in claim 11 wherein the nonporous substrate is plastic which unacceptably distorts with heat.

15. The method as set forth in claim 11 wherein the steam is applied using a plurality of steam knives.

16. The method as set forth in claim 11 further comprising applying toner to a second side of the nonporous substrate.

17. The method as set forth in claim 16 further comprising applying steam to the second side of the nonporous substrate in the fusing zone to fuse the toner on the second side.

18. The method as set forth in claim 11 further comprising glossing the substrate having toner fused thereon.

19. The method as set forth in claim 11 wherein the toner is an emulsion aggregation toner.

20. The method as set forth in claim 19 wherein the emulsion aggregation toner has a particle size of 3-4 microns with a pile height of approximately 2-3 microns.

21. The method as set forth in claim 11 wherein the substrate is a thin plastic, foil or paper material or a laminate thereof as thin as approximately 13 microns or less, which can be rewound with minimal distortion due to the printed toner and is suitable for subsequent packaging operations.

22. A fusing system comprising:

a developer and transfer unit operative to apply an emulsion aggregation toner to a nonporous substrate, the nonporous substrate being defined as a substrate that unacceptably distorts at temperatures above 130° C.;

a fusing zone defined in a print path for the nonporous substrate;

a heating tank operative to receive fluid and heat the fluid to produce steam; and, an application device positioned in the fusing zone, the application device having plurality of steam knives operative to apply the steam at approximately 100° C. and fuse the emulsion aggregation toner on the nonporous substrate.

23. The fusing system as set forth in claim 22 wherein the emulsion aggregation toner has a particle size of 3-4 microns with a pile height of approximately 2-3 microns.

24. The fusing system as set forth in claim 22 wherein the nonporous substrate is a thin plastic, foil or paper material or a laminate thereof, the nonpourous substrate being as thin as approximately 13 microns or less.

* * * * *